United States Patent [19]

Hashimoto et al.

[11] Patent Number: 4,880,482

[45] Date of Patent: Nov. 14, 1989

[54] HIGHLY CORROSION-RESISTANT AMORPHOUS ALLOY

[75] Inventors: Koji Hashimoto, 2-25-5 Shogen, Sendai, Miyagi; Kimikado Miura, Ichihara; Katsuhiko Asami; Asahi Kawashima, both of Sendai, all of Japan

[73] Assignees: Mitsui Engineering & Shipbuilding Co., Ltd., Tokyo; Koji Hashimoto, Sendai, both of Japan

[21] Appl. No.: 183,553

[22] Filed: Apr. 19, 1988

[30] Foreign Application Priority Data

Apr. 28, 1987 [JP] Japan ..... 62-105300

[51] Int. Cl.[4] ..... C22C 30/02

[52] U.S. Cl. ..... 148/403; 420/417; 420/423; 420/425; 420/426; 420/427; 420/492; 420/495; 420/587

[58] Field of Search ..... 148/403; 420/417, 423, 420/425, 426, 427, 492, 495, 587

[56] References Cited

U.S. PATENT DOCUMENTS

| | | | |
|---|---|---|---|
| 4,378,330 | 3/1983 | Verhoeuen et al. | 420/495 |
| 4,600,448 | 7/1986 | Schmidt et al. | 420/495 |
| 4,743,314 | 5/1988 | Hashimoto et al. | 148/403 |

FOREIGN PATENT DOCUMENTS

| | | | |
|---|---|---|---|
| 22345 | 2/1983 | Japan | 420/495 |

*Primary Examiner*—L. Dewayne Rutledge
*Assistant Examiner*—George Wyszomierski
*Attorney, Agent, or Firm*—Kanesaka and Takeuchi

[57] ABSTRACT

A highly corrosion-resistant amorphous Cu alloys with at least one element selected from the group of Ta and Nb and other Cu-Ta alloys with at least one element selected from the group of Nb, Ti and Zr, wherein the total content of alloying elements other than Cu ranges from 15 to 85 at %.

3 Claims, 1 Drawing Sheet

HIGHLY CORROSION-RESISTANT AMORPHOUS ALLOY

FIELD OF THE INVENTION

The present invention relates to novel amorphous alloy possessing various superior characteristics, such as extremely high corrosion resistance and high wear resistance along with considerable toughness, which can be used industrial plants such as chemical plants as well as various fields of human life.

DESCRIPTION OF THE PRIOR ART

It is generally known that a conventionally processed alloy has a crystalline structure in the solid state. However, an alloy having a specific composition becomes amorphous by prevention of the formation of long-range order structure during solidification through, for example, rapid solidification from the liquid state, sputter deposition or plating under the specific conditions; or by destruction of the long-range order structure of the solid alloy through ion implantation which is also effective for supersaturation with elements necessary for the formation of the amorphous structure.

The amorphous alloy thus formed is an extremely homogeneous supersaturated solid solution containing sufficient amounts of various alloying elements beneficial in providing specific characteristics. The amorphous alloys prepared by rapid quenching from the liquid state generally have far higher mechanical strength in comparison with currently used conventional crystalline metals. Some of the amorphous alloys possess extremely high corrosion resistance.

On the other hand, among valve metals such as Ti, Zr, Nb and Ta, Ta and Nb have especially high melting points. In particular, Ta is not melted even at the boiling point of Cu. It is, therefore, difficult to prepare Cu-base alloys containing Ta and/or Nb having high melting points by conventional melting methods even in the crystalline state. Amorphous binary Cu-Ta and Cu-Nb alloys are more difficult to be prepared, and hence are not found. Known amorphous alloys containing Cu and Nb are only Ti-Nb-Cu and Zr-Nb-Cu alloys, which are prepared by rapid quenching from the liquid state.

The present inventors studied the method for preparation of extremely corrosion-resistant amorphous Cu-base alloys containing Ta and/or Nb. They succeeded to prepare crystalline raw Cu-base alloys containing Ta and/or Nb, such as Cu-Ti-Ni-Ta and Cu-Ti-Ni-Nb alloys be remelting Cu-Ti alloy with Ni-Ta or Ni-Nb alloy. They applied melt spinning method to these alloys and succeeded to prepare extremely corrosion-resistant amorphous Cu-base alloys containing Ta and/or Nb. They made Japanese patent application No. 225677/86.

The alloys described in No. 225677/86 are as follows:

A highly corrosion-resistant amorphous alloy which consists of Ti, Ni and one or two elements selected from the group of Ta and Nb, with the balance being substantially Cu, wherein either 5 at% or more Ta or 15 at% or more Nb should be contained, the total content of Ti and said one or two elements selected from the group of Ta and Nb being 30 to 62.5 st%, the content of Ni being 0.6–4 times of Ta and/or Nb and the content of Cu being 0.6–4 times of Ti.

OBJECTIVE OF THE PRESENT INVENTION

Preparation of novel amorphous Cu-base alloys with Ta and/or Nb will develop a new method to prepare novel alloys having unknown properties, because these alloys are hardly processed by conventional melting methods even in the crystalline state.

It is, therefore, eagerly expected to prepare novel amorphous Cu-base alloys with Ta and/or Nb.

On the other hand, heretofore there has been no metallic materials except for Ta metal corrosion-resistant in concentrated hydrochloric acids, which have a poor oxidizing power and break readily down passive films protecting metallic materials in mild environments. In view of the above-foregoing, there has been a strong demand for a further new metallic material which can be used in such severe environments.

SUMMARY OF THE INVENTION

It is an objective of the present invention to provide amorphous Cu-base alloys containing Ta and/or Nb having an extremely high corrosion resistance, high wear resistance and considerable toughness, in spite of the fact that preparation of the Cu-base alloys containing Ta and/or Nb even in the crystalline state is quite difficult.

The present invention is directed to the following alloys.

(1) A highly corrosion-resistant amorphous alloy consisting of 15 to 85 at% of at least one element selected from the group of Ta and Nb, and the balance being substantially Cu.

(2) A highly corrosion-resistant amorphous alloy consisting of 15 to 85 at% in the total of at least one element selected from the group of Ti and Zr and at least 1 at% of Ta, and the balance being substantially Cu.

(3) A highly corrosion-resistant amorphous alloy consisting of 15 to 85 at% in the total of at least one element selected from the group of Ti and Zr and at least 1 at% of the sum of Ta and Nb, and the balance being substantially Cu.

1: Central axis of the chamber, 2: Substrate, 3,4 and 5; Targets, 6: Sputtering Chamber.

DESCRIPTION OF THE PREFERRED EMBODIMENTS

The present invention aims to provide amorphous Cu-base alloys containing Ta and/or Nb having an extremely high corrosion resistance, high wear resistance and considerable toughness, in spite of the fact that preparation of the Cu-base alloys containing Ta and/or Nb even in the crystalline state in quite difficult.

As mentioned previously, the present inventors in investigating corrosion-resistant amorphous alloys succeeded to prepare extremely corrosion-resistant amorphous Cu-Ti-Ni-Ta and Cu-Ti-Ni-Nb alloys by melt spinning and made Japanese patent application No. 225677/86. On the basis of these investigations the present inventors continued to study preparation methods of amorphous alloys and their characteristics. The present inventors, by using sputtering method which does not require mixing of alloy constituents by melting, succeeded to prepare amorphous binary Cu-Nb alloys and other amorphous Cu-valve metal alloys containing Ta as an indispensable element, and found that these alloys possess an extremely high corrosion resistance due to formation of a protective passive film even in very aggressive acids of a poor oxidizing power such as concentrated hydrochloric acids. The present invention has been thus accomplished.

Table 1 shows the components and compositions of the alloys set forth in the claims.

TABLE 1

Compositions of alloys of the present invention (at %)

| Embodiment | Ta | Ta, Nb | Ti, Zr | Cu*1 |
|---|---|---|---|---|
| 1 | | 15–85*2 | | Balance |
| 2 | at least 1 | | 15–85*3 | Balance |
| 3 | | at least 1*4 | 15–85*5 | Balance |

*1Substantially Cu
*2At least one element selected from the group of Ta and Nb,
*3Total of Ta and at least one element selected from the group of Ti and Zr,
*4Sum of Ta and Nb
*5Total of at least one element selected from the group of Ti and Zr and the sum of Ta and Nb.

Sputtering is one of methods for preparation of amorphous alloys. Preparation of the alloys of the present invention is carried out by sputtering. Sputtering is often carried out by using a sintered or alloyed crystalline target of multiple phases whose average composition is the same as the composition of the amorphous alloy to be prepared. Sputtering is also performed by using a target consisting of a metal sheet of one of constituents in the amorphous alloy to be prepared and other metal constituents placed on or embeded in the metal sheet.

Figure 1:
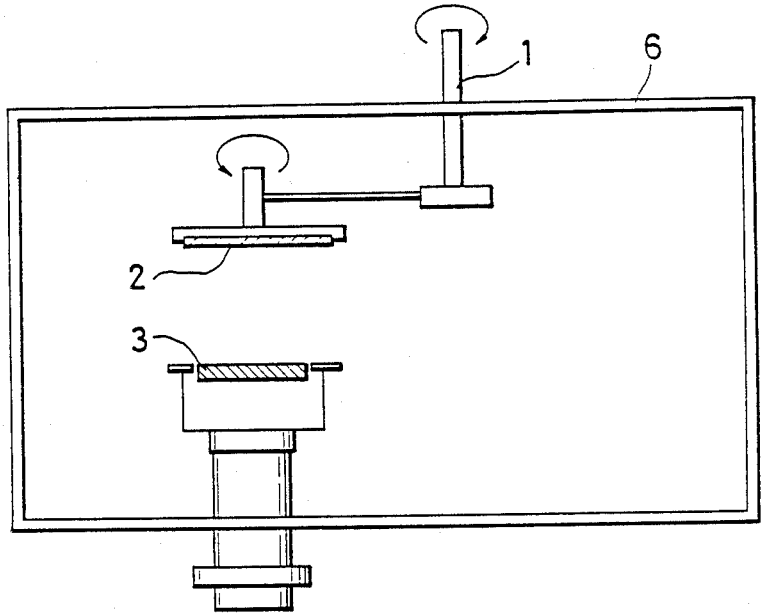
FIGS. 1 and 2 shows apparatuses for preparing an alloy of the present invention.

In the present invention, it is difficult to form alloy targets of Cu with valve metals, and hence targets consisting of a Cu disc which carries small pieces of at least one element selected from the group of Ta and Nb are used. In this manner extremely corrosion-resistant amorphous Cu-Ta, Cu-Nb and Cu-Ta-Nb alloys can be prepared by using valve metal-placed Cu disc targets. The apparatus shown in FIG. 1 can be used. In order to avoid local compositional heterogeneity of sputtered alloys, it is desirable to carry out revolution of the substrate disc 2 around a central axis 1 of the sputtering chamber 6 in addition to revolution of the substrate disc itself around the center of the substrate disc. The orbit of the substrate disc is just above the center of the target 3.

Figure 2:
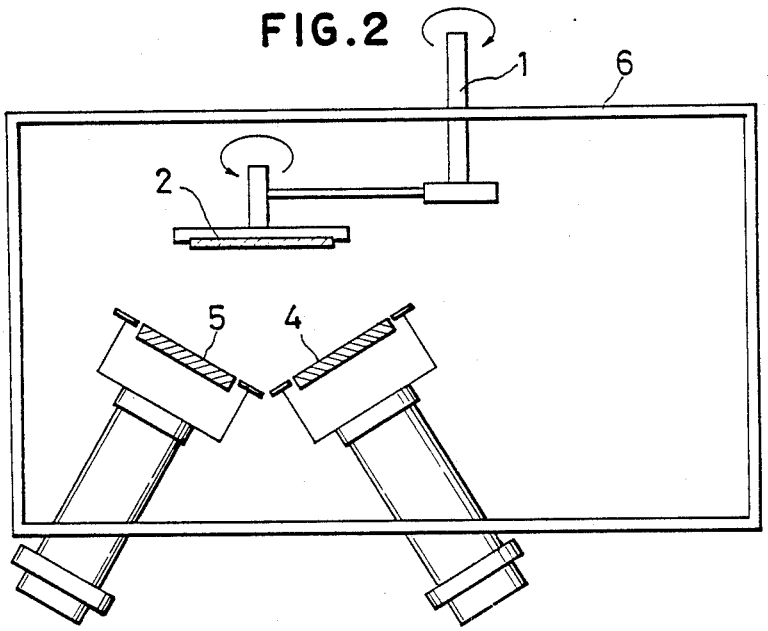

In order to change widely the composition of the amorphous alloy formed, the apparatus shown in FIG. 2 can be used. For instance, if a Cu disc is used as a target 4, a Ta-embeded Cu disc is used as a target 5. These two targets are installed obliquely in the sputtering chamber 6, in such a way that the intersection of the normals to the centers of these two targets is on the orbit of the center of the substrate disc 2 revolving around a central axis 1 of the sputtering chamber 6 in addition to revolving the substrate disc itself around the center of the substrate disc. When these two targets are independently operated by two independent power sources, amorphous Cu-Ta alloys are formed whose compositions are dependent upon the relative powers of two targets.

In this manner by using different single targets or by using different various combinations of two targets, extremely corrosion-resistant different amorphous alloys of different compositions ar prepared, such as Cu-Ta, Cu-Nb, Cu-Ta-Nb, Cu-Ta-Ti, Cu-Ta-Zr, Cu-Ta-Ti-Zr, Cu-Ta-Nb-Ti, Cu-Ta-Nb-Zr and Cu-Ta-Nb-Ti-Zr alloys.

The amorphous alloys produced by sputtering are single-phase alloys in which the above-mentioned alloying elements exist in a state of uniform solid solution. Accordingly, they form an extremely uniform and highly corrosion-resistant protective passive film in a poorly oxidizing environment.

Metallic materials are readily dissolved in a poorly oxidizing very aggressive hydrochloric acid. Therefore, the metallic materials intended for use in such an environment should have an ability to form a stable protective passive film. This objective is achieved by an alloy containing effective elements as much as necessary. However, it is not desirable to add various alloying elements in large quantities to a crystalline metal, because the resulting alloy is of a multiple phase mixture, with each phase having different chemical properties, and is not so satisfactory in corrosion resistance as intended. Moreover, the chemical heterogeneity is rather harmful to corrosion resistance.

By contrast, the amorphous alloys of this invention are of homogeneous solid solution. Therefore, they homogeneously contain effective elements as much as required to form uniformly a stable passive film. Owing to the formation of this uniform passive film, the amorphous alloys of this invention exhibit a sufficiently high corrosion resistance.

In other words, metallic materials to withstand a poorly oxidizing hydrochloric acids should form a uniform, stable passive film in such environments. Alloys of amorphous structure permit many alloying elements to exist in a form of a singlephase solid solution, and also permit the formation of a uniform passive film.

The components and compositions of the alloys of this invention are specified as above for the following reasons:

Valve metals such as Ta, Nb, Ti and Zr are able to form the amorphous structure when they coexist with Cu. For the formation of the amorphous structure by sputtering, the Cu alloys consisting of Cu and at least one element of Ta, Nb, Ti and Zr require to contain 15–85 at% of valve metals. Except for Cu alloys with at least one element of the group of Ti and Zr and Cu-Nb alloys with at least one element of the group of Ti and Zr, such as Cu-Ti, Cu-Zr, Cu-Ti-Zr, Cu-Nb-Ti, Cu-Nb-Zr and Cu-Nb-Ti-Zr, amorphous binary Cu-Nb alloys and other amorphous Cu-base alloys containing Ta are prepared only by sputtering and are included in embodiments of the present invention. The present invention excludes the alloys containing less than 1 at% of Ta and those contain less than one at% of the sum of Ta and Nb because these alloys may be regarded as the same as those composed of Cu and at least one element selected from the group of Ti and Zr without containing Ta, such as Cu-Ti, Cu-Zr, Cu-Ti-Zr, Cu-Nb-Ti, Cu-Nb-Zr and Cu-Nb-Ti-Zr.

Ta, Nb, Ti and Zr provide a high corrosion resistance due to formation of a protective passive film in a poorly oxidizing acid, and hence the amorphous alloys of the present invention have a sufficiently high corrosion resistance in corrosive environments such as hydrochloric acids.

The objective of the present invention can be achieved even if the alloys contain at most 5 at% of Mo and/or W.

The highly corrosion-resistant amorphous alloy of the present invention will be further illustrated by certain examples which are provided only for purpose of illustration and are not intended to limit the present invention.

EXAMPLE 1

The target consisted of 6 Ta discs of 20 mm diameter and 10 mm thickness placed symmetrically in a Cu disc of 100 mm diameter and 6 mm thickness so as to place the center of Ta discs on a concentric circle of 58 mm diameter on the surface of the Cu disc. The sputtering apparatus shown in FIG. 1 was used. Substrates were an A1 disc, Type 304 stainless steel disc and a piece of glass, which were revolved around the central axis of the sputtering chamber during revolution of the substrates themselves around the center of the substrates. Sputtering was carried out at the power of 900 watts under purified Ar stream of 10 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Cu-82,4 at% Ta alloy.

The corrosion test of this alloy was carried out by immersion in 12 N HCl at 30° C. for 100 hours, but the corrosion weight loss was not detected by a microbalance since the corrosion weight loss was less than the detection limit of the microbalance, that is, $7\times10^{-4}$ mm/year.

EXAMPLE 2

The sputtering apparatus shown in FIG. 2 was used in which Cu target disc of 100 mm diameter and 6 mm thickness and the target consisted of 6 Ta discs of 20 mm diameter and 10 mm thickness placed symmetrically in a Cu disc of 100 mm diameter and 6 mm thickness so as to place the center of Ta discs on a concentric circle of 58 mm diameter on the surface of the Cu disc were installed. Substrates were in A1 disc, Type 304 stainless steel disc and a piece of glass which were revolved around the central axis of the sputtering chamber during revolution of the substrates themselves around the center of the substrates. Sputtering was carried out at the power of the Cu target of 120 watts and at the power of the Ta-placed Cu target of 725 watts under purified Ar stream of 10 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Cu-40.0 at% Ta alloy.

The corrosion test of this alloy was carried out by immersion in 12 N HCl at 30° C. for 100 hours, but the corrosion weight loss was not detected by a microbalance since the corrosion weight loss was less than the detection limit of the microbalance, that is, $7\times10^{-4}$ mm/year.

EXAMPLE 3

The sputtering apparatus shown in FIG. 2 was used in which Cu target disc of 100 mm diameter and 6 mm thickness and the target consisted of 6 Ta discs of 20 mm diameter and 10 mm thickness placed symmetrically in a Cu disc of 100 mm diameter and 6 mm thickness so as to place the center of Ta discs on a concentric circle of 58 mm diameter on the surface of the Cu disc were installed. Substrates were an A1 disc, Type 304 stainless steel disc and a piece of glass which were revolved around the central axis of the sputtering chamber during revolution of the substrates themselves around the center of the substrates. Sputtering was carried out at the power of the Cu target of 120 watts and at the power of the Ta-placed Cu target of 600 watts under purified Ar stream of 10 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Cu-20.4 at% Ta alloy.

The corrosion test of this alloy was carried out by immersion in 12 N HCl at 30° C. for 100 hours, but the corrosion weight loss was not detected by a microbalance since the corrosion weight loss was less than the detection limit of the microbalance, that is, $7\times10^{-4}$ mm/year.

EXAMPLE 4

The sputtering apparatus shown in FIG. 2 was used in which various combinations of two targets were installed.

Sputtering conditions and procedures similar to those described in Examples 2 and 3 were applied. By this procedure amorphous Cu-62.4 at% Ta, Cu-52.7 at% Ta, Cu-31.8 at% Ta, Cu-22.0 at% Ta and Cu-15.3 at% Ta alloys were prepared.

The fact that these alloys are all in the amorphous state was confirmed by X-ray diffraction.

The corrosion test of these alloys was carried out by immersion in 12 N HCl at 30° C. for 100 hours, but corrosion weight losses of all the alloys were not detected by a microbalance since the corrosion weight losses were less than the detection limit of the microbalance, that is, $7\times10^{-4}$ mm/year.

EXAMPLE 5

The sputtering apparatus shown in FIG. 2 was used in which Cu and Nb target discs of 100 mm diameter and 6 mm thickness were installed. Substrates were an A1 disc, Type 304 stainless steel disc and a piece of glass which were revolved around the central axis of the sputtering chamber during revolution of the substrates themselves around the center of the substrates. Sputtering was carried out at the power of the Cu target of 200 watts and at the power of the Nb target of 600 watts under purified Ar stream of 10 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Cu-73.2 at% Nb alloy.

The corrosion test of this alloy was carried out by immersion in 12 N HCl at 30° C. for 100 hours, but the corrosion weight loss was not detected by a microbalance since the corrosion weight loss was less than the detection limit of the microbalance, that is, $7\times10^{-4}$ mm/year.

EXAMPLE 6

The sputtering apparatus shown in FIG. 2 was used in which various combinations of two targets were installed.

Sputtering conditions and procedures similar to those described in Example 5 were applied. By this procedure amorphous Cu-67.0 at% Nb, Cu-51.7 at% Nb, Cu-44.8 at% Nb and Cu-15.5 at% Nb alloys were prepared.

The fact that these alloys are all in the amorphous state was confirmed by X-ray diffraction.

The corrosion test of these alloys was carried out by immersion in 12 N HCl at 30° C. for 100 hours, but corrosion weight losses of all the alloys were not detected by a microbalance since the corrosion weight losses were less than the detection limit of the microbalance, that is, $7\times10^{-4}$ mm/year.

EXAMPLE 7

The sputtering apparatus shown in FIG. 2 was used in which various combinations of two targets, such as Ta-placed Cu target and Nb-placed Cu target, Ta-placed Cu target and Nb target, Ta-placed Cu target and Ti target, Ta-placed Cu target and Zr target, Ta- and Nb-placed Cu target and Ti target, Ta- and Nb-placed Cu target and Zr target and Ta- and Nb-placed Cu target and Ti- and Zr-placed Cu target were installed.

Sputtering conditions and procedures similar to those described in Examples 2–6 were applied. By this procedure amorphous alloys were prepared. The compositions of the alloys obtained by electron probe microanalysis are shown in Table 2.

The fact that these alloys are all in the amorphous state was confirmed by X-ray diffraction.

TABLE 2

| | Compositions of Amorphous Alloys (at %) | | | | |
|---|---|---|---|---|---|
| Alloy | Cu | Ta | Nb | Ti | Zr |
| 1 | 83.3 | 10.3 | 5.4 | | |

TABLE 2-continued

| | Compositions of Amorphous Alloys (at %) | | | | |
|---|---|---|---|---|---|
| Alloy | Cu | Ta | Nb | Ti | Zr |
| 2 | 34.7 | 30.2 | 35.1 | | |
| 3 | 17.3 | 47.7 | 35.0 | | |
| 4 | 16.7 | 8.3 | | 75.0 | |
| 5 | 21.3 | 40.2 | | 38.5 | |
| 6 | 18.9 | 4.8 | 4.4 | 71.9 | |
| 7 | 17.9 | 8.9 | | | 73.2 |
| 8 | 16.3 | 7.7 | 7.2 | | 68.8 |
| 9 | 21.1 | 5.2 | 6.8 | 35.5 | 31.4 |

The corrosion test of these alloys was carried out by immersion in 12 N HCl at 30° C. for 100 hours, but corrosion weight losses of all the alloys were not detected by a microbalance since the corrosion weight losses were less than the detection limit of the microbalance, that is, $7\times10^{-4}$ mm/year.

What is claimed is:

1. A highly corrosion-resistant amorphous alloy consisting of 15 to 85 at% of at least one element selected from the group consisting of Ta and Nb, and the balance being substantially Cu.

2. A highly corrosion-resistant amorphous alloy consisting of 15 to 85 at% in the total of at least 1 at% of Ta and at least one element selected from the group consisting of Ti and Zr, and the balance being substantially Cu.

3. A highly corrosion-resistant amorphous alloy consisting of 15 to 85 at% in the total of at least one element selected from the group consisting of Ti and Zr and at least 1 at% of the sum of Ta and Nb, and the balance being substantially Cu.

* * * * *